US006497018B1

(12) United States Patent
Chiu et al.

(10) Patent No.: US 6,497,018 B1
(45) Date of Patent: Dec. 24, 2002

(54) STRUCTURE OF A COFFIN

(76) Inventors: Jin-Hsien Chiu, PO Box 82-144, Taipei (TW); Chin-Lang Chen, PO Box 82-144, Taipei (TW)

( * ) Notice: Subject to any disclaimer, the term of this patent is extended or adjusted under 35 U.S.C. 154(b) by 0 days.

(21) Appl. No.: 09/938,566

(22) Filed: Aug. 27, 2001

(51) Int. Cl.[7] ..... A61G 17/00
(52) U.S. Cl. ..... 27/2; 220/4.28
(58) Field of Search ..... 27/4, 2, 35; 220/4.28, 220/4.32, 617, 615, 621, 4.31; 229/198.2; 217/12 R

(56) References Cited

U.S. PATENT DOCUMENTS 1,439,450 A * 12/1922 Scott ..... 220/682
2,162,137 A * 6/1939 Torricelli ..... 52/142
5,419,448 A * 5/1995 Watson ..... 220/4.28
5,743,421 A * 4/1998 Gonzalez et al. ..... 220/4.28
6,018,853 A * 2/2000 Chen et al. ..... 27/2

* cited by examiner

*Primary Examiner*—William L. Miller
(74) *Attorney, Agent, or Firm*—Leong C. Lei

(57) ABSTRACT

An improved structure of a coffin is disclosed. The coffin comprises a base seat board, a left side board and right side board, a rear side board and a front side board, and a top cover, characterized in that the left and right sides of the base seat board are provided with inverted T-shaped sliding slots and the top and bottom of the base seat board are provided with recesses, and the bottom of the left and right side boards is provided with an inverted T-shaped sliding rail and the top of the left and right side boards are provided with T-shaped sliding slots, the left and right end of the front and rear side boards are provided with T-shaped sliding rails, and the bottom thereof is provided with a protruded board, the top cover board along the edge thereof is provided with slots so that the top cover board can be connected to the left and right side boards.

2 Claims, 8 Drawing Sheets

STRUCTURE OF A COFFIN

BACKGROUND OF THE INVENTION (a) Field of the Invention

The present invention relates to an improved structure of a coffin, and in particular, to a coffin which is formed by combining a plurality of boards together via the formation of dovetail connection structure. The boards include a base seat board, a left and a right side board, a front side and a rear side board, and a top cover board. The coffin is made from paper materials such as recycle paper, or cardboards.

(b) Description of the Prior Art

Conventional coffins are made from wood and are usually formed as a unit. It is rather laborious and wasting of time in the fabrication process of making these conventional coffins. Besides, they are bulky, heavy and occupy space, and are not convenient to store after production. The conventional coffin may cause hazards to the environment. Accordingly, it is an object of the present invention to provide an improved structure of a coffin, which mitigates the above drawbacks.

SUMMARY OF THE INVENTION

An object of the present invention is to provide an improved structure of a coffin, comprising a base board, a top cover board, a left side and a right side board, a front and a rear side board, wherein a "T"-shaped sliding slot provided on one edge of the board can be inserted and combined with an inverted "T"-shaped sliding slot so that the boards of the coffin are secured.

Yet another object of the present invention is to provide an improved structure of a coffin, wherein the coffin can be easily stored, and the cost of transporting is greatly reduced.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPUON OF THE PRESENT INVENTION

Figure 1:
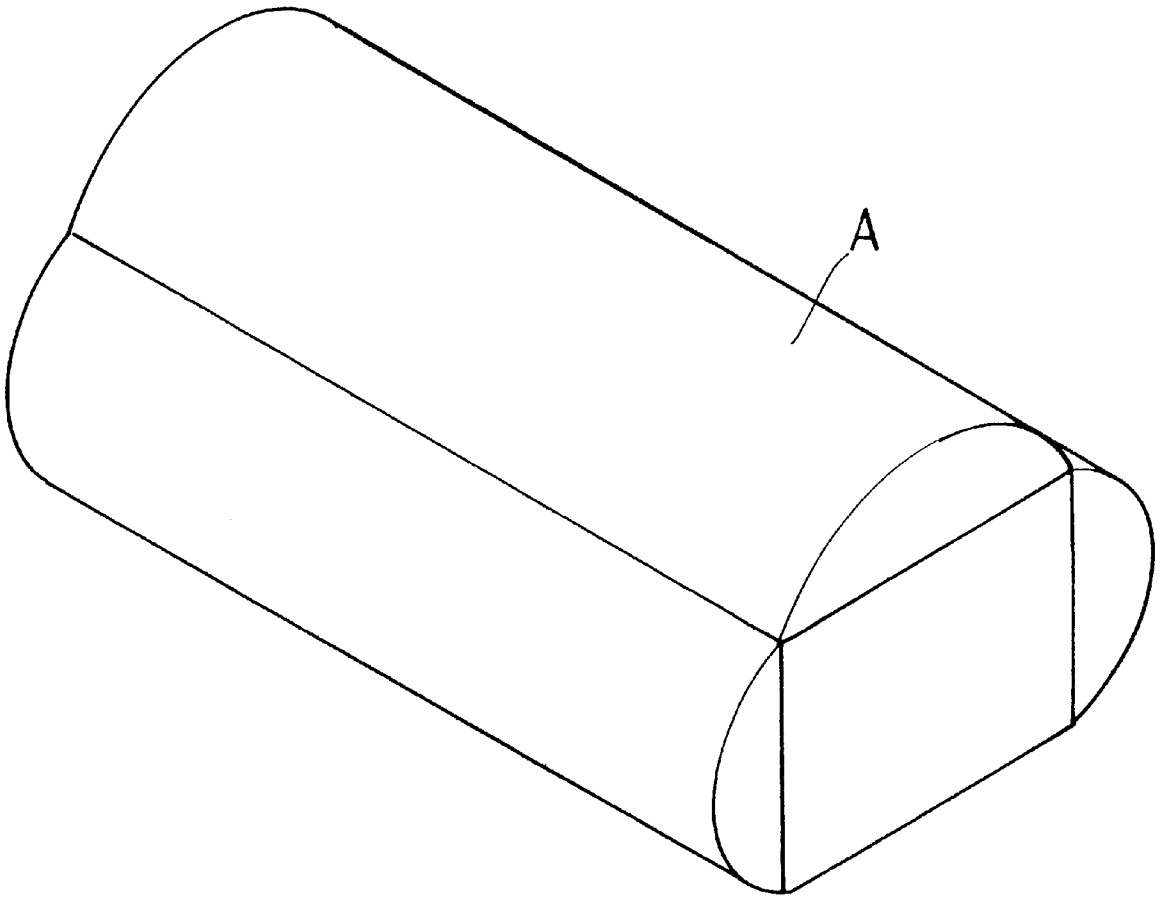
PRIOR ART FIG. 1
FIG. 1 is a perspective view of a conventional coffin.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, alterations and further modifications in the illustrated device, and flurther applications of the principles of the invention as illustrated herein being contemplated as would normally occur to one skilled in the art to which the invention relates.

Figure 2:
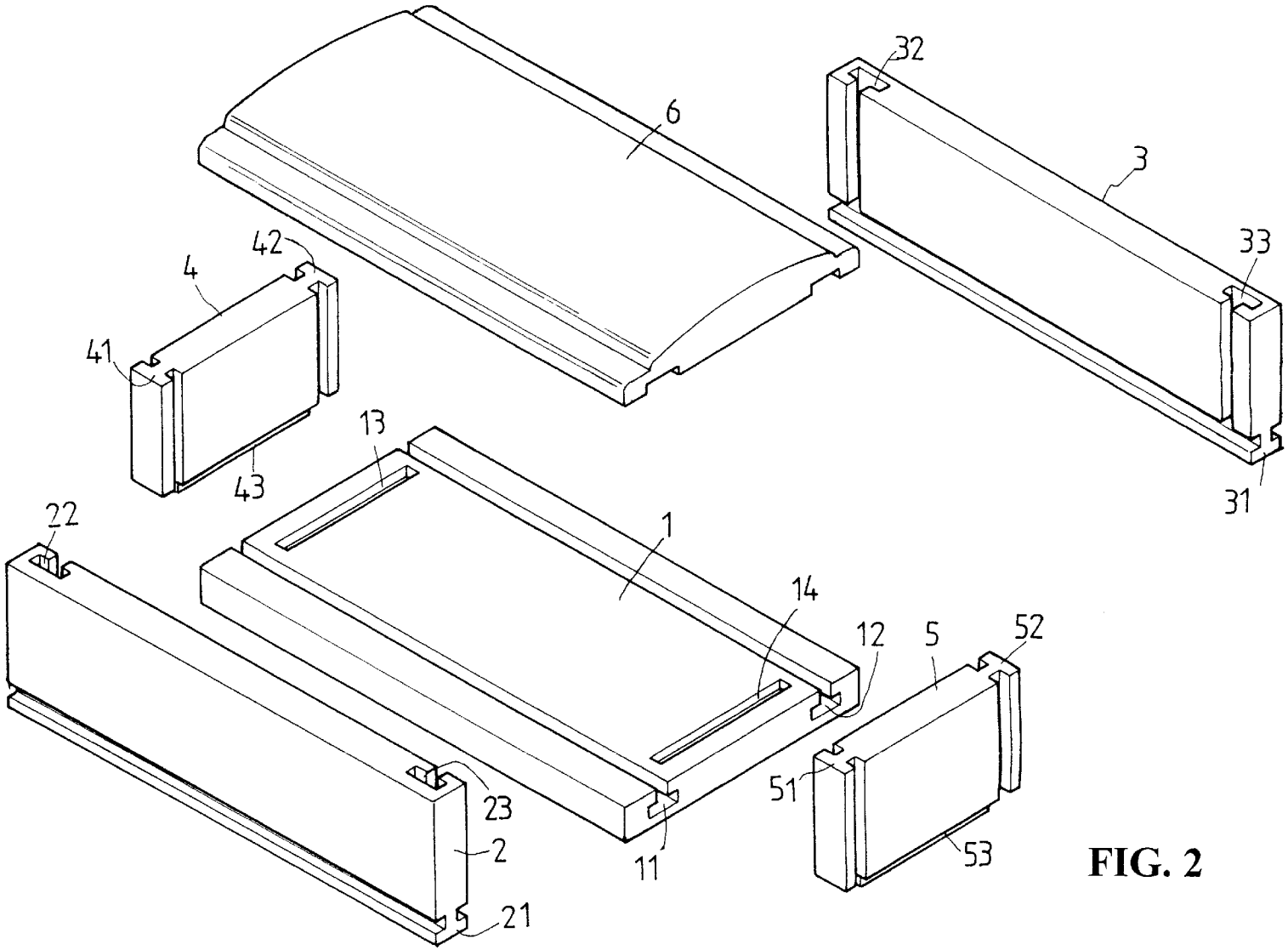
FIG. 2 is an exploded perspective view of a coffin of the present invention.
Figure 2A:
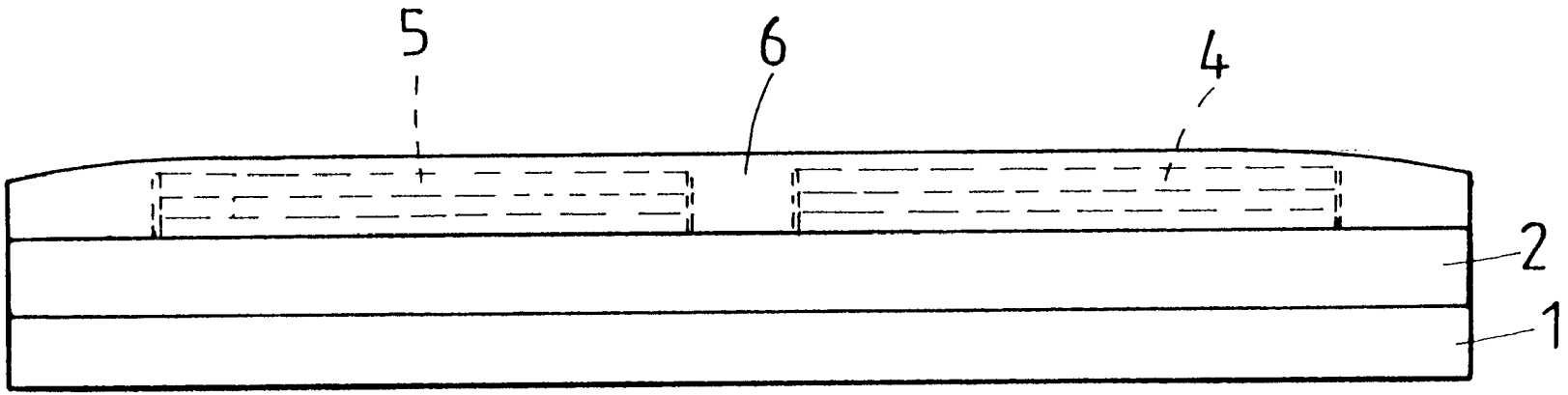
FIG. 2A show a side view of the coffin in a compressed form for transporting in accordance with the present invention.
Figure 2B:
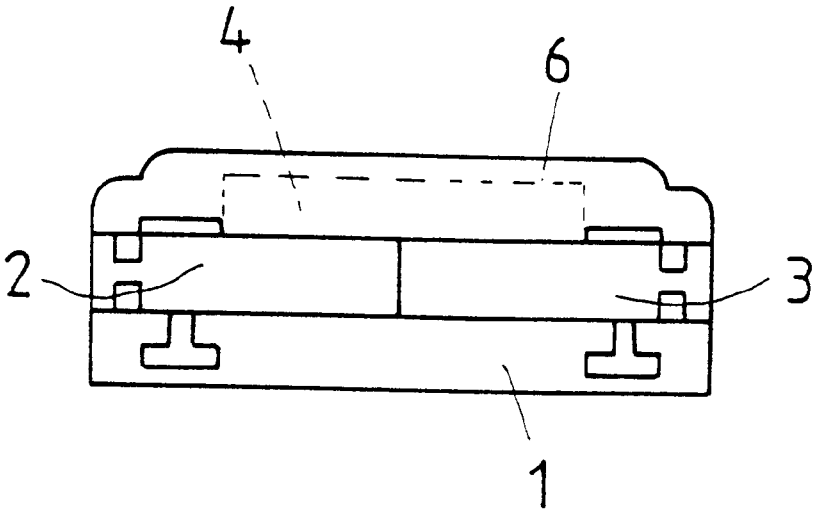
FIG. 2B show the front view of the coffin in a compressed form for transporting in accordance with the present invention.
Figure 3:
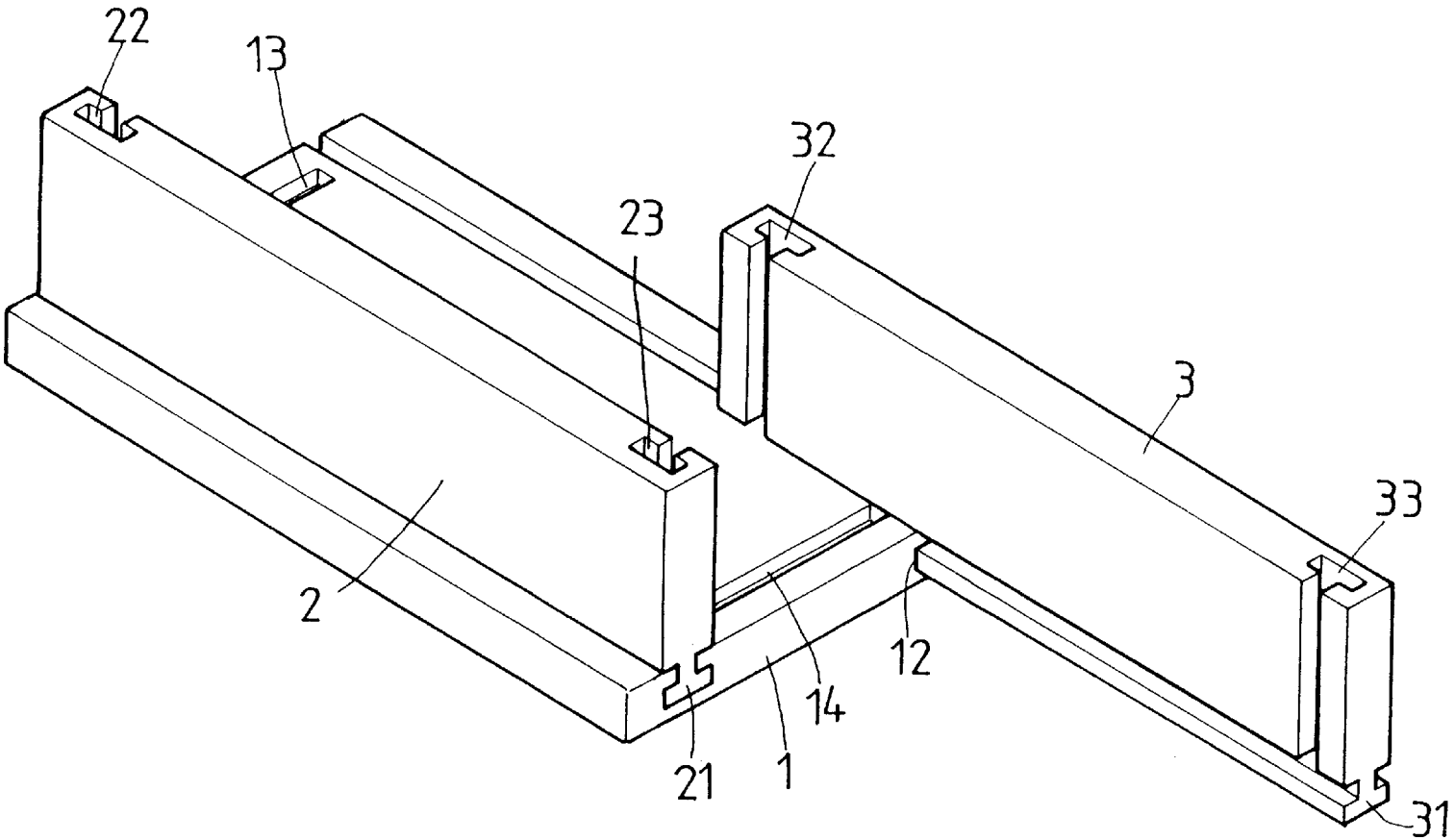
FIG. 3 is a perspective view showing the mounting of the left and right side board onto the base seat board in accordance with the present invention.

Referring to FIG. 2, FIG. 2A and FIG. 2B, there is shown a coffin comprising a base seat board 1, a left side board 2, a right side board 3, a front side board 4, a rear side board 5 and a top cover board 6, wherein the left and right side edges of the base seat board 1 are provided with invcrtcd T-shaped sliding slots 11, 12 so that the left and right side boards 2, 3 can be mounted to the base seat board 1. Recesses 13, 14 are provided on the base seat board 1 and the front and rear side boards 4, 5 can-then be mounted. Next, the bottoms of the left and right side boards 2, 3 are provided with inverted T-shaped sliding rails 21, 31 for the combination with the inverted T-shaped sliding slots 11, 12 at the left and right sides of the base seat board 1. There are T-shaped sliding slots 22, 32, 23, 33 provided on the top and bottom of the left and right side boards 2, 3 for the mounting together with the front and rear side boards 4, 5.

The left and right ends of the front and rear boards 4, 5 are provided with T-shaped sliding rails 41, 51, 42, 52 to combine with the T-shaped sliding slots 22, 32, 23, 33 on the left and right side boards 2, 3. The bottom of the front and rear side boards 4, 5 is provided with protruded boards 43, 53 to combine with the recesses 13, 14 of the base seat board 1 to form a dovetail combination.

Figure 4A:
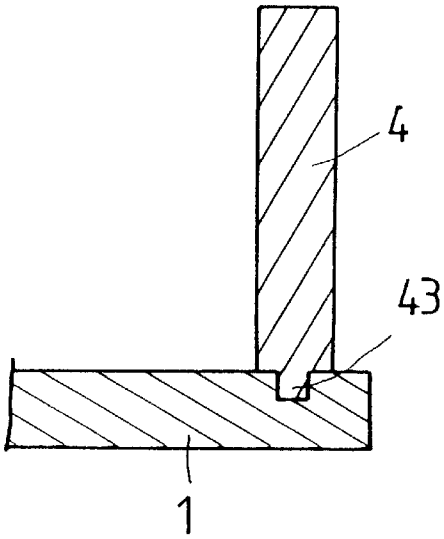
FIG. 4A is a sectional view showing the mounting of the protruded board of the bottom section of the rear and front board with the recess of the base board in accordance with the present invention.
Figure 4:
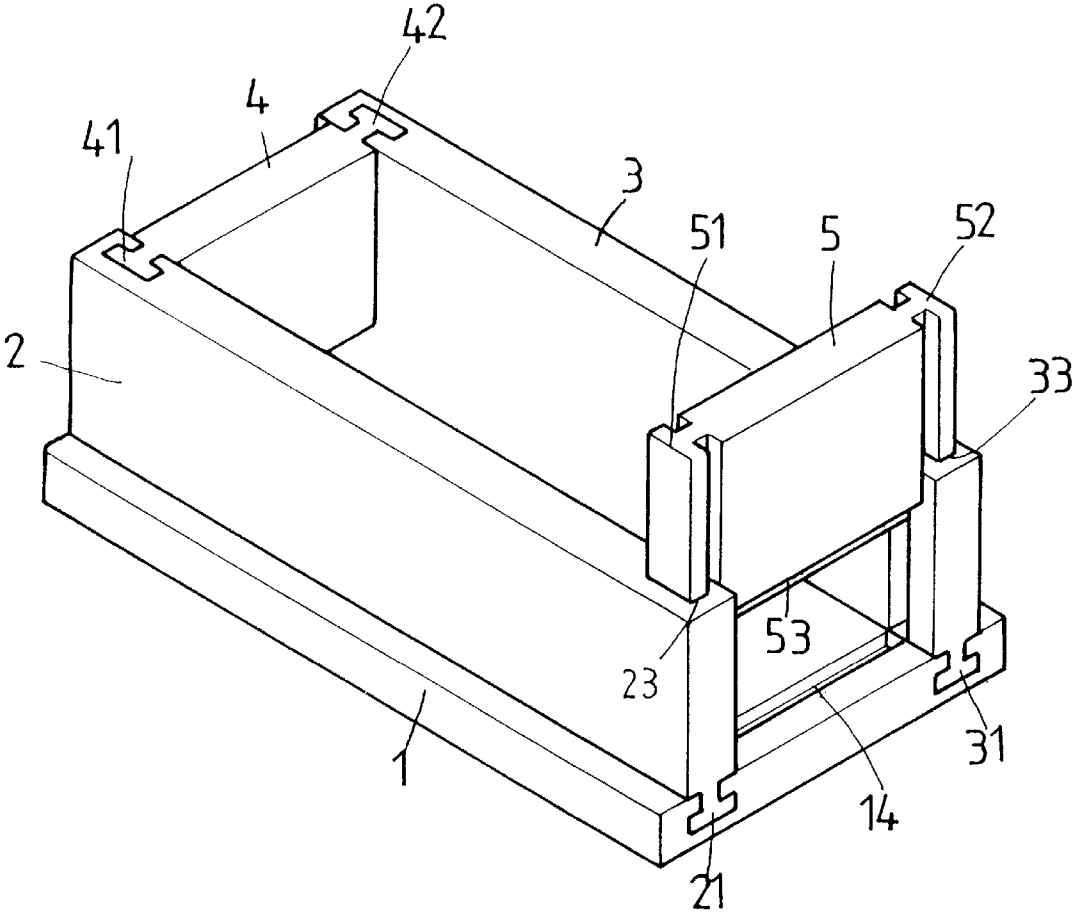
FIG. 4 is a perspective view showing the mounting of the top and bottom board onto the base seat board in accordance with the present invention.
Figure 5:
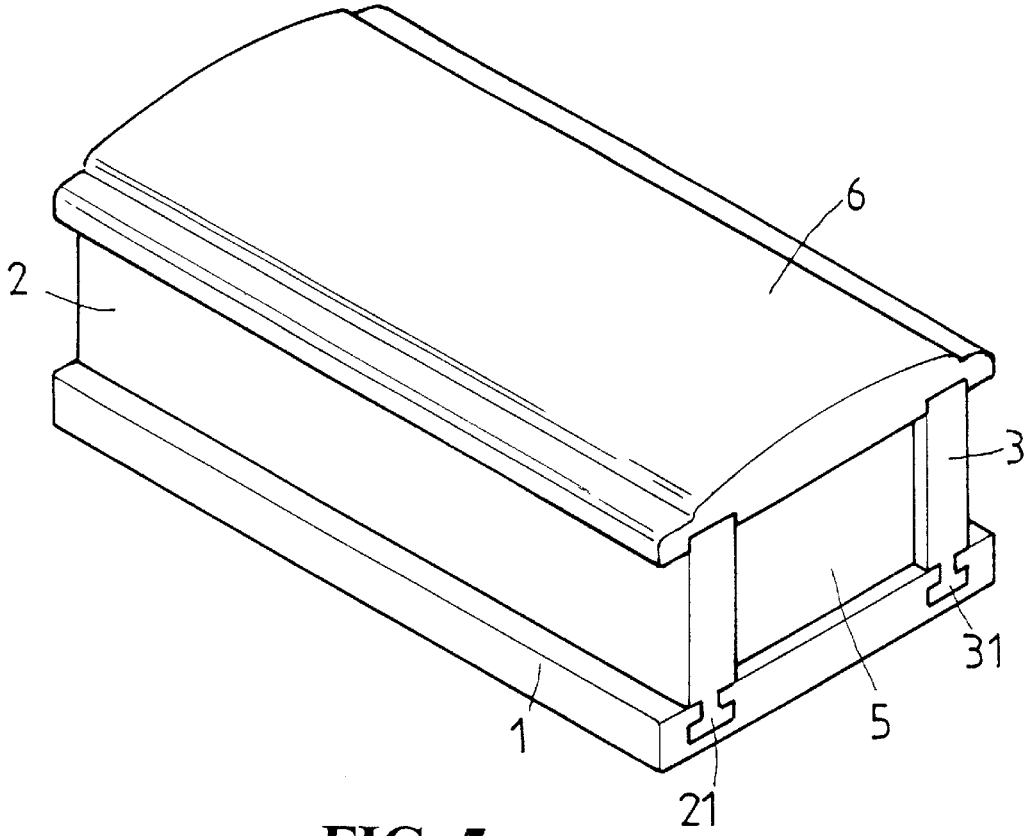
FIG. 5 is a perspective view of the coffin in accordance with the present invention when the top cover board is mounted onto the top of the coffin.

FIGS. 3 to 6 illustrate the formation of the coffin structure in accordance with the present invention. In accordance with the present invention, the bottom seat board 1 is first placed onto the ground, and the inverted T-shaped sliding rail 21 and the inverted T-shaped sliding slot 11 are mounted together and the inverted T-shaped sliding rail 31 and the inverted T-shaped sliding slot 12 are mounted and are then mounted onto the base seat board 1. Referring to FIG. 4, the T-shaped sliding rails 41, 42 at the left and right ends of the front board 4 are then mounted together with the T-shaped sliding slots 22, 32 at the left and right side boards 2, 3. The protruded board 43 at the bottom of the front board 4 is combined with the recess 13 of the base seat board 1 to form a dovetail connection (referring to FIG. 4A). Similarly, referring to FIG. 4, the T-shaped sliding rails 51, 52 at the left and right end of the rear board 5 are combined with the T-shaped sliding slots 23, 33 of the left and right side boards 2, 3. At this instance, the protruded board 53 of the rear side board 5 forms a dovetail connection with the recess 14 of the base seat board 1 (as shown in FIG. 4A), and finally, the top cover board 6 is mounted (as shown in FIG. 5).

Figure 5A:
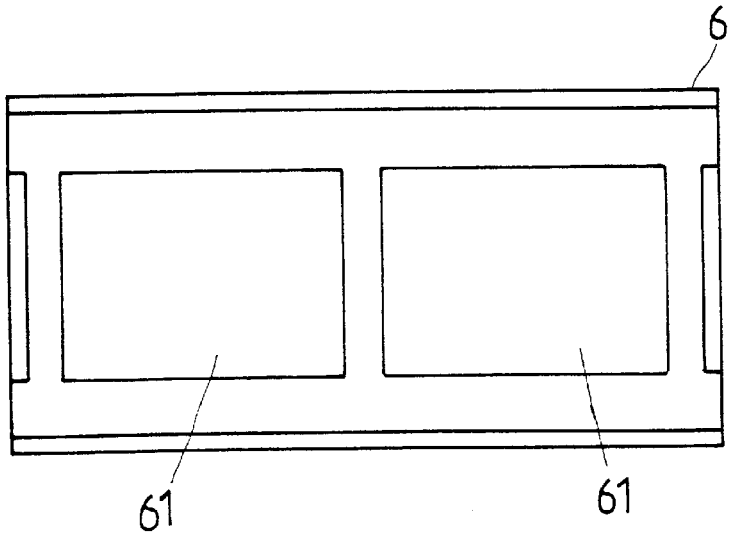
FIG. 5A is the front view of the back of the top cover board of the present invention.
Figure 6:
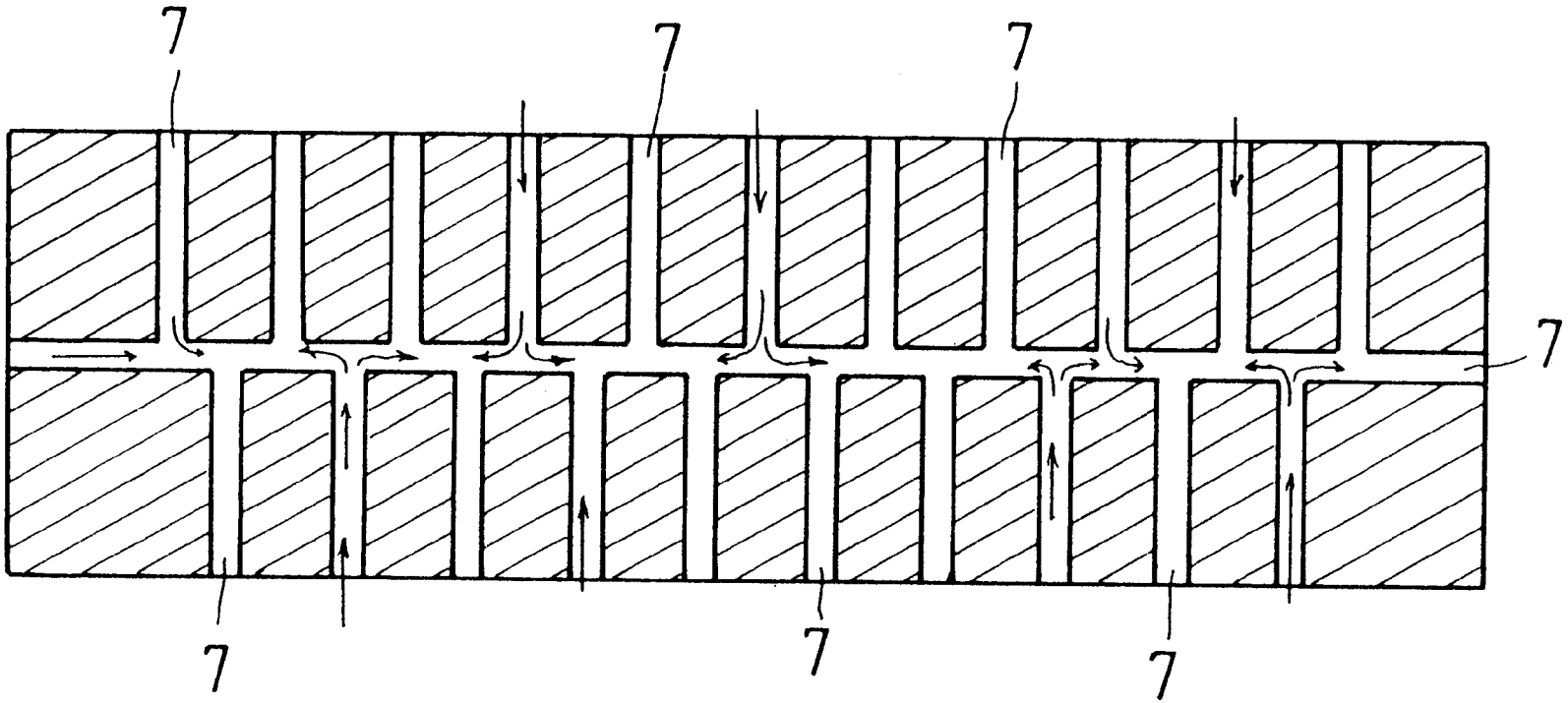
FIG. 6 is a schematic view showing the ventilation within the board structure of the present invention.

In accordance with the present invention, the back of the top cover board 6 is provided with two cavities 61 (as shown in FIG. 5A) which hold the front and rear sides boards 4, 5 therein during traporting.

In accordance with the present invention, the coffin is made from paper materials such as waste paper or cardboards or recycles paper. These raw materials are compressed and dried. Thus, the cost of production of the present coffin structure is low. In accordance with the present invention, within the boards, there are paths for ventilation air (refer to FIG. 6) so that in the course of cremation, the coffin will be bumnt within a short time.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skluled in the art without departing in any way from the spirit of the present invention.

We claim:

1. An improved structure of a coffin comprising a base seat board, a left side board and a right side board, a rear side board and a front side board, and a top cover board, the base seat board having a left, right, front, and rear side, a top, and a bottom wherein the left and right sides of the base seat board are provided with inverted T-shaped sliding slots and the top of the base seat board is provided with recesses adjacent the front and rear side thereof, a bottom of the left and right side boards is provided with an inverted T-shaped sliding rail and a top of the left and right side boards is provided with T-shaped sliding slots, left and right ends of the front and rear side boards are provided with T-shaped sliding rails, two cavities are provided on a back surface of the top cover board to hold the rear and front side boards during transporting, a bottom of the front and rear side boards is provided with a protruded board, and the top cover board is provided with slots adapted to engage with upper edges of the left and right side boards.

2. The improved structure of a coffin of claim 1, wherein said boards have paths for ventilation air for enabling said coffin to be burnt in a short time.

* * * * *